US005165582A

United States Patent [19]

Andrews

[11] Patent Number: 5,165,582

[45] Date of Patent: Nov. 24, 1992

[54] SEWING MACHINE THREADING GUIDE AND METHOD

[76] Inventor: Patricia L. Andrews, 5200 Irvine Blvd., Irvine, Calif. 92720

[21] Appl. No.: 744,434

[22] Filed: Aug. 13, 1991

[51] Int. Cl.[5] ..... D05B 87/07

[52] U.S. Cl. ..... 223/99; 112/225; 112/262.1; 112/197

[58] Field of Search ..... 112/302, 224, 225; 223/50, 102, 103, 104, 105, 99

[56] References Cited

U.S. PATENT DOCUMENTS

| | | | |
|---|---|---|---|
| 2,448,432 | 8/1948 | Huning | 223/99 |
| 3,233,800 | 2/1966 | Catania | 223/102 |
| 3,404,707 | 10/1968 | Feld | 223/99 X |
| 3,838,801 | 10/1974 | David | 223/99 |
| 4,011,658 | 3/1977 | Tarrson et al. | 223/99 X |
| 4,133,339 | 1/1979 | Naslund | 223/102 X |
| 4,667,860 | 5/1987 | Feuerman | 223/99 |
| 4,802,581 | 2/1989 | Takahashi | 223/99 X |

*Primary Examiner*—Werner H. Schroeder
*Assistant Examiner*—Paul C. Lewis
*Attorney, Agent, or Firm*—Lynn & Lynn

[57] ABSTRACT

A length of a flexible material such as a monofilament nylon is folded back on itself to form a loop and an elongated guide portion. The ends and portions of the flexible material adjacent the ends are fastened together. The trailing end portion of the loop is crimped so that when the loop is flattened, it folds at the crimp. A sewing thread that has been introduced into the loop is retained as it is drawn through the narrow passages of a serger sewing machine.

14 Claims, 4 Drawing Sheets

SEWING MACHINE THREADING GUIDE AND METHOD

BACKGROUND OF THE INVENTION

The conventional home sewing machine has either one or two needles and in combination with a bobbin forms a seam which, when executed properly, generally unites two or more pieces of material.

Another type of sewing machine, initially called an overlock machine, now more commonly referred to as a serger, has been made available to the home sewer. The serger cuts the fabric being fed into the machine and the loopers and needles encase the cut edge of the material with a chain-like edge of thread or other flexible filament to prevent the cut edge from fraying. In the case of only one layer of fabric introduced into the machine, the serger cuts and encapsulates. In the case of more than one layer of fabric being introduced into the machine, the serger cuts, encapsulates and unites, all in one operation. The stitch fingers, i.e., small projections or prongs on the needle plate or presser Foot then feed the stitches encasing the fabric off the machine.

Like most conventional sewing machines, the serger uses one or two needles. Unlike most conventional sewing machines, the serger has no bobbin; therefore in some respects the loopers replace the work of the bobbin. Thus a series of loopers along with the needles perform the sewing operation.

Different models of sergers utilizing from two to five spools of thread are available with each machine offering various types of stitches; however for the purpose of describing the invention herein, a machine utilizing four spools of thread with two needles and two sets of loopers will be described. The present invention functions satisfactorily with any serger sewing machine.

In addition to other mechanisms found on the machine not strictly relative to the invention, sergers have thread guide bars, tension discs and guides which create a thread path. A four-spool serger would have four bar guides, four tension discs and approximately 12 thread guides. Thread path information is posted on each machine and if followed correctly, makes threading of the guides, discs and thread guides relatively easy as the guides, discs and thread guides are positioned both on top and on front of the serger. The front of the machine faces the operator thereby placing bars, discs and guides in plain view.

Threading the loopers is another matter as they are located in an almost-impossible-to-reach cavity beneath the working surface of the machine.

All threading is done sequentially: bar guides, tension discs, thread guides, upper looper, lower looper and finally the needle or needles. Flexible filaments are withdrawn from spools placed on spindles to the rear and/or side of the machine. The filament or, in case of more than one, filaments are drawn from each spool one at a time by hand and placed through each relative bar guide, tension disc and thread guide until thread and/or threads have been drawn from all the corresponding spools and all bar guides, tension discs and thread guides have been threaded and the filaments are now ready to be passed through the eyes of the upper looper, lower looper and needle or, in case of two needles, needles.

Each looper contains two eyes and because they are in the heretofore mentioned difficult-to-reach undercarriage of the serger, threading the looper eyes is virtually impossible without the aid of some type of threading device.

In some cases tweezers are used to thread the eyes of loopers. For purposes of clarity let us assume that one length of thread is being used in each needle, therefore it is herein assumed the operator has drawn the thread through the bars, discs and guides and is prepared to thread the loopers. The operator must pinch the cut end of the thread between the opposed, pointed end of the tweezers and carefully insert the cut end through the looper eyes. The application herein described is difficult to manage because of the confined area wherein the loopers are placed therefore this threading technique is generally not within the scope of manual dexterity of many operators.

Another method of threading is to use a fine wire loop which has been encased within one end of a relatively long metal tube holder having a tab handle at the opposite end of the wire loop. After drawing the thread by hand through bars, discs and guides, the operator need pierce each looper eye with the fine wire loop, thereinafter pass the wire loop through the eye, thread the leading cut end of the flexible filament through the already inserted wire loop then withdraw the loop from the eye, leaving the flexible filament passed through that particular looper eye. This procedure must be practiced for each eye in each looper. The wire in the wire threader, by necessity, is so fine that it bends and ultimately breaks after being used only a few times. As heretofore mentioned, the space herein described is extremely limited and the length and rigidity of this wire loop threader precludes a swift threading procedure.

Specific instructions as to correct threading procedure are provided with each individual serger machine and must be followed exactly if the serger is to operate properly. If the serger is threaded incorrectly or if the sewing threads become tangled or if the sewing threads become broken, the machine will not stitch properly and the threading procedure must be repeated from the beginning and if the color of the thread needs to be changed, the threading process must be repeated from the beginning.

The needles are threaded thereafter.

U.S. Pat. No. 4,667,860 discloses a needle having a trailing deformable loop made of thin spring steel wire, flexible plastic or other deformable material while the body of the needle is formed of a rigid material such as steel hypodermic tubing. The rigid body of this device would not allow the device to negotiate the constrictive cavity of the undercarriage of a serger. Therefore the inadequacies of this invention for threading a serger sewing machine are evident.

U.S. Pat. Nos. 3,929,144 and 4,133,339 disclose a looped filament for guiding dental floss between a person's teeth. The looped filament is not formed in a manner that would permit it to be used to thread the intricacies of the serger because the thread could be easily separated from the device.

SUMMARY OF THE INVENTION

The present invention closely resembles a needle, however the thread guide has a blunt end, not a pointed one. The invention has a leading guide portion which can be curved by hand to conform to the confined under-carriage of the serger and yet the leading guide portion is rigid enough to reach and penetrate the almost inaccessible first eyes of both upper and lower loopers.

The thread guide according to the present invention has a relatively small deformable loop on the opposite end of the leading guide portion. The loop is small enough to retain a fine sewing thread therein during the threading process. The small loop is preferably crimped at the trailing end to facilitate fine sewing thread retention.

The present invention in one form embodies a looped length of a relatively flexible strand-like material with the ends thereof bonded together to form an elongated portion with a blunt tip; the leading guide portion having sufficient rigidity so that it can be inserted through the eyes of loopers found in a serger sewing machine, the looped segment having been crimped to retain fine sewing threads. The cut end of a length of flexible filament, such as but not limited to thread coming from a cone or spool already placed on a spindle of the serger, is drawn through the bar guides, tension discs, and guides of the machine. The cut end of the flexible filament is passed through the crimped loop and the elongated leading end of the thread guide with the filament passed through the loop is threaded through the eyes of the loopers until the flexible filament is threaded through all the eyes of all the loopers wherein the flexible filament is withdrawn from the thread guide leaving the flexible filament passed through all the bar guides, tension discs and loopers. At this point, the thread guide is set aside for further use.

Therefore, it is an object of this invention to provide an implement for threading flexible filament through several orifices in a swift and efficient manner. It is another object to provide an economical threading guide for threading these hard-to-reach areas.

DESCRIPTION OF PREFERRED EMBODIMENT

Figure 1:
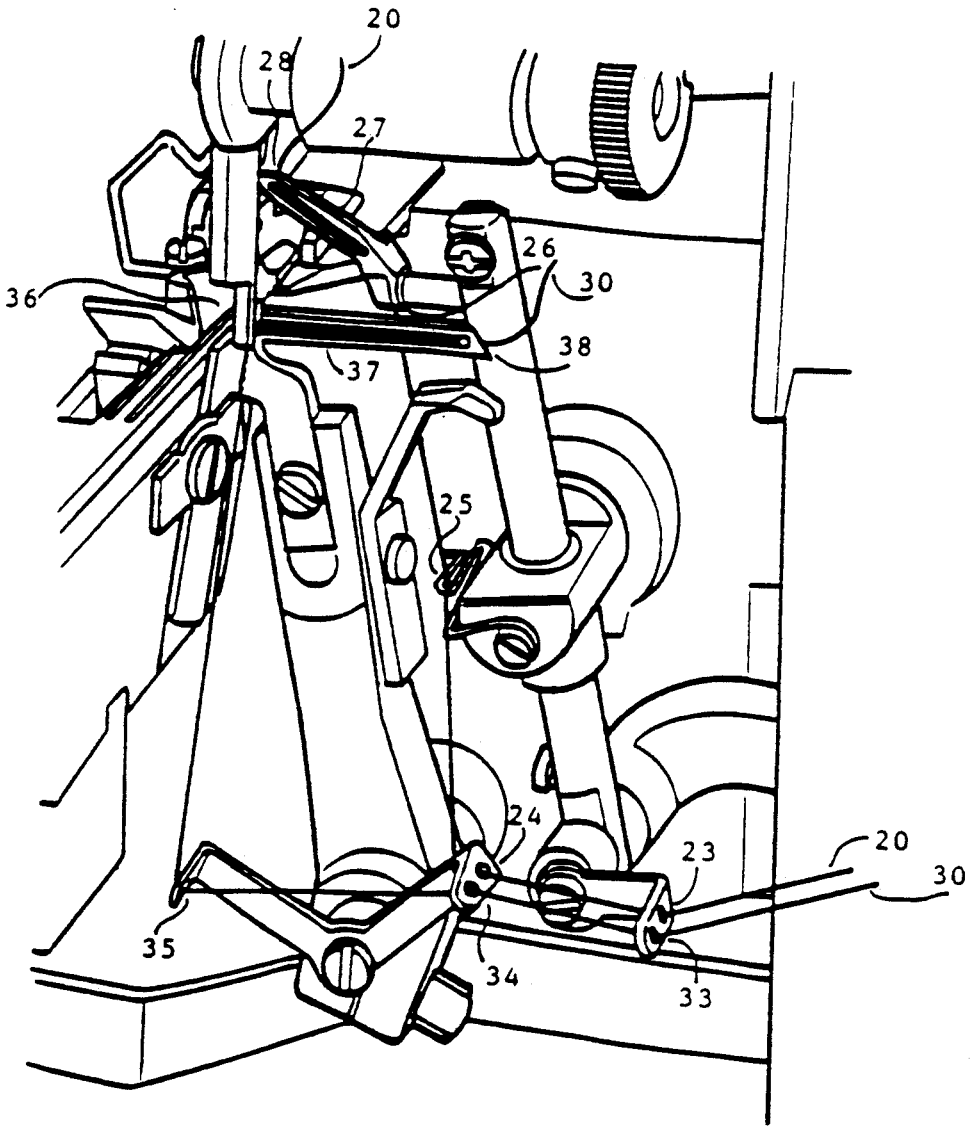
FIG. 1 illustrates a serger sewing machine showing both upper and lower loopers already having been threaded and showing the relative relationship of both upper and lower looper and the close proximity in which they are necessarily positioned to perform the function of the serger sewing machine.

FIG. 1 shows an illustration of an upper looper 27 and a lower looper 37 of a serger sewing machine threaded with flexible filament and juxtaposed in one of many positions necessary to achieve the sewing process and the partial thread path of the machine. The looper arms, being at the uppermost end of each looper, rotate on a stationary base and the looper arms pass each other on a vertical plane within a fixed arc. Flexible filament such as sewing thread 20 coming from a source such as but not limited to a spool (not illustrated) is shown threaded through guides 23, 24 and 25 then threaded through the first eye 26 of looper 27 wherein the filament is shown exiting through second eye 28 of the looper 27. FIG. 1 also shows an illustration of flexible filament such as sewing thread 30 coming from a spool (not illustrated) threaded through guides 33, 34 and 35 then threaded through the first eye 36 of looper 37 wherein the filament is shown exiting through second eye 38 of the looper 37.

Figure 2:
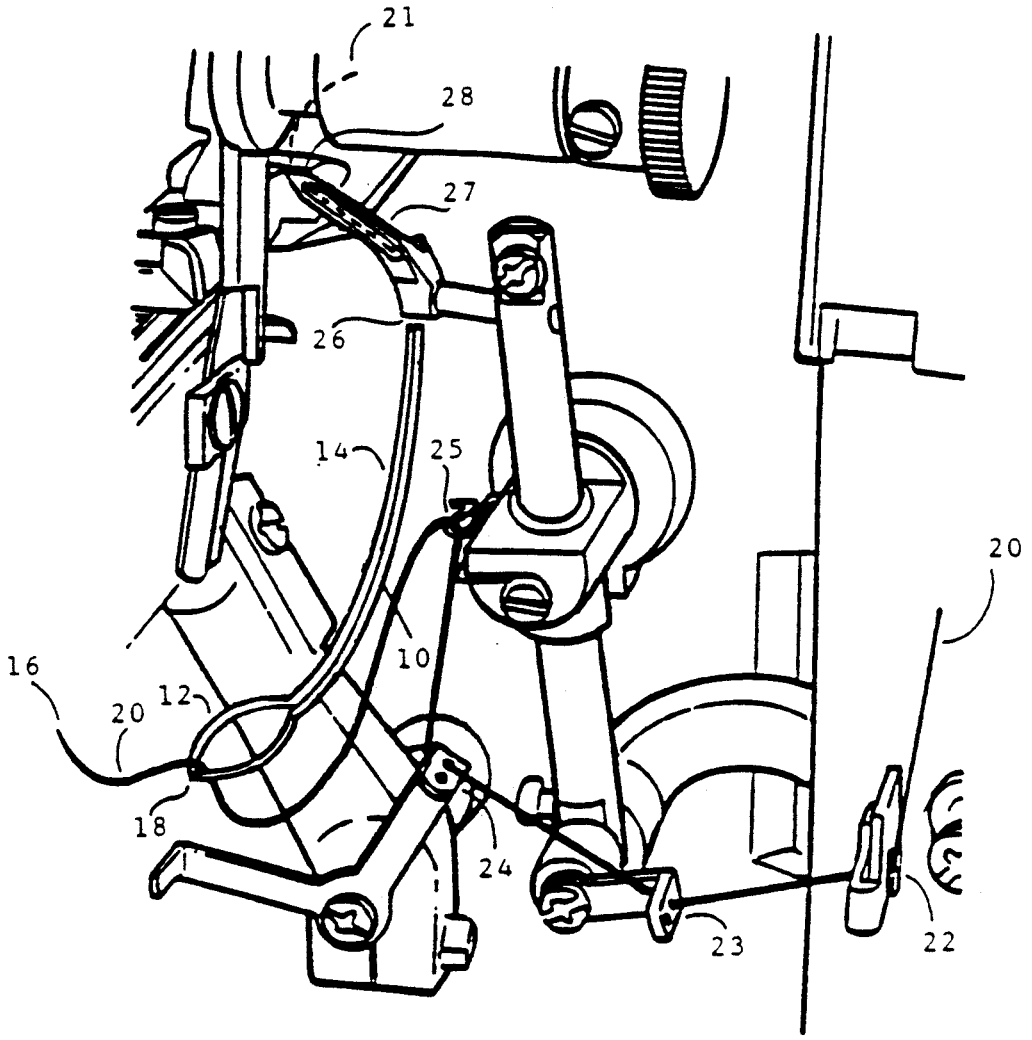
FIG. 2 illustrates the upper looper of a serger sewing machine and a thread guide according to this invention being used to insert a length of flexible filament into the first eye of a set of two eyes of the upper looper.

FIG. 2 shows an illustration of upper looper 27 of a serger sewing machine and a partial thread path of the machine. Flexible filament such as sewing thread 20 coming from a source such as, but not limited to a spool (not illustrated) is threaded through guides 22, 23, 24 and 25. A thread guide 10 according to the present invention is employed by threading leading cut end 16 of thread 20 through a crimped loop 12.

Preferably 6 to 7 inches of thread 20 are drawn through loop 12 leaving already threaded guides 22 through 25 intact. The threading device 10 includes an elongated portion 14 that extends from the loop 12. Elongated guide portion 14 with connected thread 20 is introduced through eye 26 of upper looper 27 wherein thread guide 10 is passed therethrough until thread guide 10 and thread 20 are passed through eye 26 of upper looper 27. Elongated guide portion 14 with connected thread 20 is introduced through eye 28 of upper looper 26 wherein thread guide 10 is passed therethrough until thread guide 10 and thread 20 are passed through eye 28 of upper looper 26. Broken line 21 shows the finished thread path of successfully threaded upper looper 27. Thread 20 is thereafter removed from thread guide 10 and is positioned for further use in the sewing process.

Figure 3:
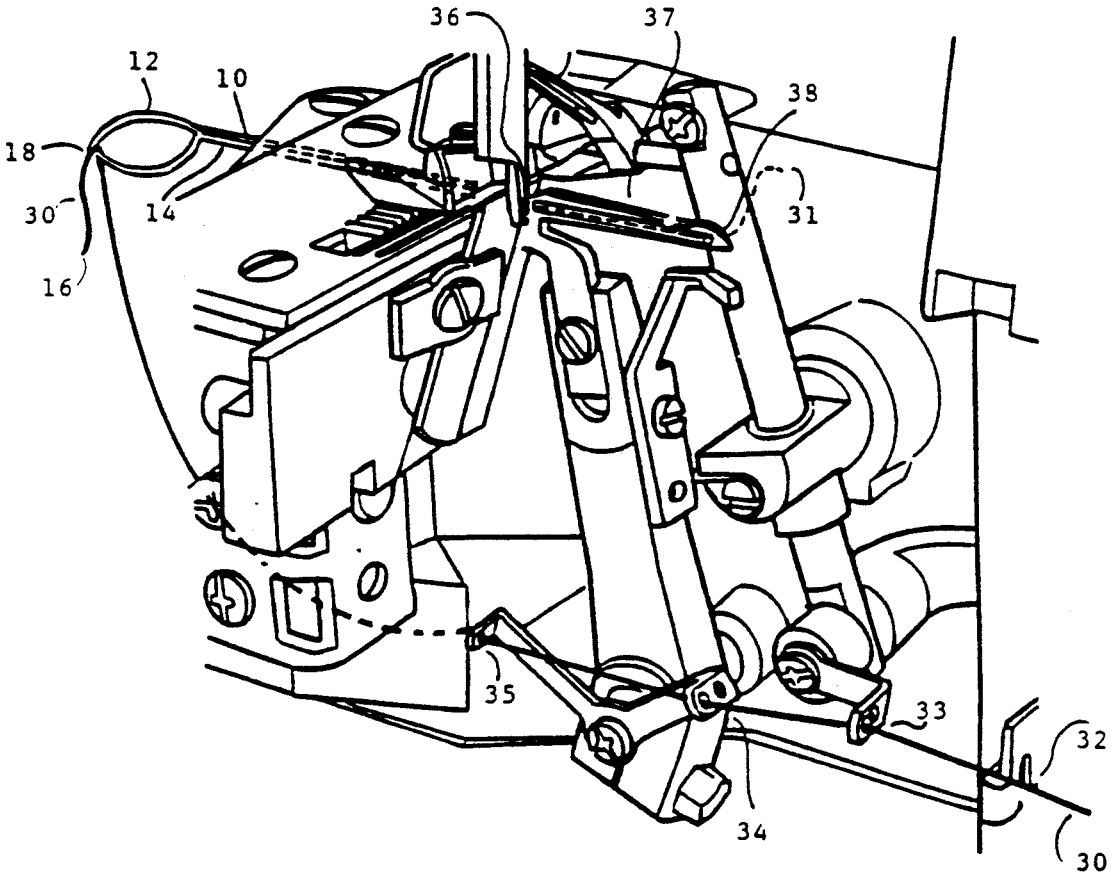
FIG. 3 illustrates the lower looper of a serger sewing machine and a thread guide according to this invention being used to insert a length of flexible filament into the first eye of a set of two eyes of the lower looper.
Figure 4:
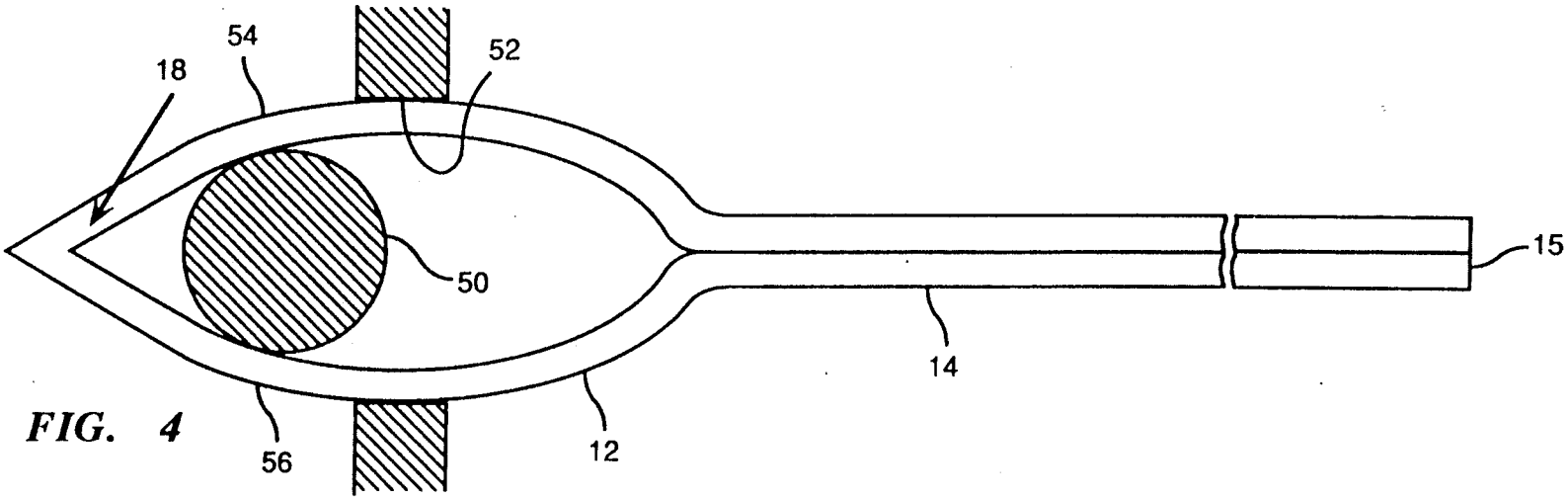
FIG. 4 illustrates the thread guide of FIGS. 2 and 3 being used to guide a relatively large diameter sewing thread through a passage.

FIG. 3 shows an illustration of lower looper 37 of a serger sewing machine and a partial thread path of the machine. Flexible filament such as sewing thread 30 coming from a source such as but not limited to a spool (not illustrated) is threaded through guides 32, 33, 34 and 35. Thread guide 10 is employed by threading leading cut end 16 of thread 30 through crimped loop 12.

Preferably 6 to 7 inches of thread 30 are drawn through loop 12 leaving already threaded guides 32 through 35 intact. The threading device 10 includes an elongated portion 14 that extends from the loop 12. Elongated guide portion 14 with connected thread 30 is introduced through eye 36 of lower looper 37 wherein thread guide 10 is passed therethrough until thread guide 10 and thread 30 are passed through eye 36 of lower looper 37. Elongated guide portion 14 with connected thread 30 is introduced through eye 38 of lower looper 36 wherein thread guide 10 is passed therethrough until thread guide 10 and thread 30 are passed through eye 38 of lower looper 36. Broken line 31 shows the finished thread path of successfully threaded lower looper 37. Thread 30 is thereafter removed from thread guide 10 and is positioned for further use in the sewing process.

Figure 5:
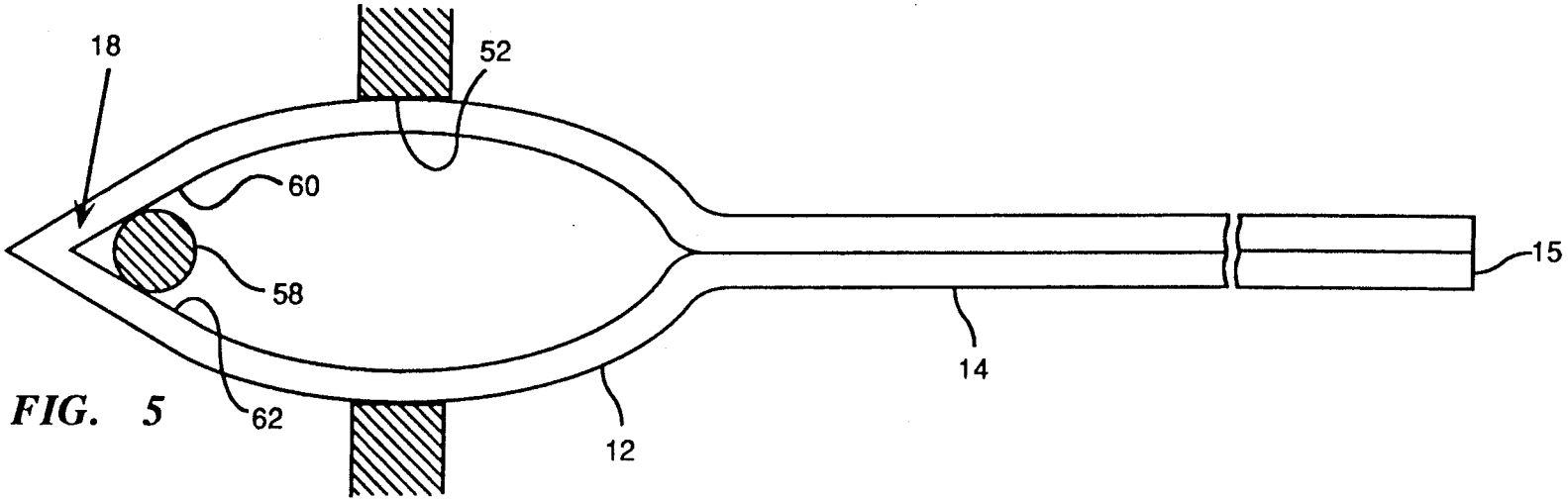
FIG. 5 illustrates the thread guide of FIGS. 2 and 3 being used to guide a relatively small diameter thread through a passage.

FIG. 5 shows a relatively small diameter thread 58 being retained in the deformable loop 12 while it is being drawin through a narrow passage 52. The deformable loop 12 folds at the crimp 18 so that the thread 58 is pinched between flattened portions 60 and 62 of the loop 12 which is on opposite side of the leading guide 14. The thread guide 10 is formed of a semi-rigid material and deformation of the small loop 12 would be difficult without crimp 18. The crimp 18 makes it possible for the loop to flatten thereby allowing it to pass through all the passages in the thread path yet still retain its capability of thread 58 retention.

The guide portion 14 has a leading end 15 formed by cutting across the length of the guide portion at a 90° angle. The thread guide 10 is preferably formed of a flexible nylon strand-like filament. The guide portion 14 preferably has a diameter that is twice the diameter of the filament that forms the deformable loop 12. The diameter of the guide portion 14 of the filament preferably is approximately 0.0030 inch. The loop 12 preferably has a length of approximately 0.75 inch.

With the use of the thread guide, sewing thread can be readily and easily positioned through the eyes of both upper and lower loopers. Since the material from which the thread guide is fashioned is relatively durable, the thread guide can be used repeatedly with all types of sewing machine filaments.

While particular embodiments of the invention have been described in connection with the threading process of a serger sewing machine, the easy threading features of the present invention are equally advantageous in other threading applications such as that used in darning, or for the application of yarn. The crimped end of the filament loop provides secure retention of small diameter threads as well as bulky yarns. The monofilament material of which the thread guide preferably can be made ranges in diameter from 0.0010 inches to 0.60 inches. Because the material is flexible and deformable, the thread guide can be used over and over again. The loop of the thread guide is flexible and deformable thereby retaining its original shape and dimension over the life of the device.

The present invention also provides a threading device and method for threading the eye or, in case of multiple needles, the eyes of conventional sewing machines. A flexible filament is passed through the loop which is then, with the flexible filament passed therethrough, guided through the eye of the needle or eyes of the needles of a conventional sewing machine.

The present invention may also be used to close a seam, to add decorative threads or yarns in a pleasing pattern or to put up a hem in an already knitted garment. Flexible filaments such as yarn are passed through the loop of the thread guide then the thread guide with decorative threads or yarns having been passed therethrough, is threaded through the loops of knitted material to complete the task required.

While the invention has been disclosed herein in connection with certain specific embodiments of the same, it will be understood that this is intended by way of illustration only, and that modifications may be made in the configuration of the threader as well as in the steps of the method by which it is formed without departing from the spirit of the invention and it is intended the invention and these modifications be covered by the appended claims.

What is claimed is:

1. A thread guide for threading loopers of a serger sewing machine by inserting a sewing filament through a small passage to thread the loopers of the serger sewing machine, comprising:

a length of a flexible filament having a first end and a second end, the flexible filament being folded back on itself with portions of the flexible filament adjacent the first and second ends being joined to form an elongated guide portion and a deformable loop, the deformable loop having a leading end connected to the elongated guide portion and a trailing end diametrically opposed to the leading end; and retainer means formed in the trailing end of the deformable loop for pinching the sewing filament when the deformable loop is flattened by passing it through the small passage.

2. The thread guide of claim 1 wherein the deformable loop has a size small enough to allow the thread guide with the sewing filament being in the deformable loop to pass through all eyes of all loopers of a serger sewing machine.

3. The thread guide of claim 1 wherein the retainer means comprises a crimp formed in the flexible filament inside the deformable loop such that the deformable loop folds at the crimp to pinch the sewing filament.

4. The thread guide of claim 1 wherein the deformable loop is of such small size as to prevent sewing filaments introduced therein from slipping through the deformable loop.

5. The thread guide of claim 1 wherein the retainer means comprises a crimp formed in the flexible filament inside the deformable loop to pinch fine sewing filaments introduced into the deformable loop.

6. The thread guide of claim 1 wherein the leading guide portion is rigid enough to allow penetration of the eyes of upper and lower loopers of a serger sewing machine.

7. The thread guide of claim 1 wherein the leading end is flexible enough to facilitate operation within the limited space of the undercarriage of a serger sewing machine.

8. The thread guide of claim 1 wherein the leading guide portion is cut across the leading end in a 90 degree angle.

9. The thread guide of claim 1 wherein the flexible filament material is a nylon strand-like filament.

10. The thread guide of claim 1 wherein the leading guide portion is made of nylon filament having a cross sectional diameter exactly twice the cross sectional diameter of the deformable loop.

11. The thread guide of claim 1 wherein the flexible filament material has a diameter of approximately 0.0030 inch.

12. The thread guide of claim 4 wherein the looped end is approximately 1/5th the total length of the device.

13. A method for threading a serger sewing machine by inserting a sewing filament through a small passage to thread the loopers of the serger sewing machine, comprising the steps of:

forming a length of a flexible filament;

forming a crimp in the flexible filament;

folding the flexible filament back on itself at the crimp to form an elongated guide portion and a deformable loop; and placing a sewing filament in the deformable loop;

passing the elongated guide portion through the small passage to lead the deformable loop into the passage such that the flexible loop folds at the crimp to pinch the sewing filament and take it into the small passage.

14. A method for forming a guide for threading a sewing machine with a sewing filament through a small passage of a looper of a serger sewing machine, comprising the steps of:

forming a length of a flexible filament;

forming a crimp in the flexible filament;

folding the flexible filament back on itself at the crimp to form a deformable loop and an elongated guide portion comprising two portions of the flexible filament extending from the deformable loop; and fastening the two portions of the flexible filament together such that the flexible loop is capable of folding at the crimp to pinch the sewing filament and take it into one or more small passages while the sewing machine is being threaded.

* * * * *